US005104584A

United States Patent [19]

Kong

[11] Patent Number: 5,104,584

[45] Date of Patent: Apr. 14, 1992

[54] COMPOSITION AND METHOD FOR FABRIC ENCRUSTATION PREVENTION COMPRISING A LIGNIN DERIVATIVE

[75] Inventor: Stephen B. Kong, Alameda, Calif.

[73] Assignee: The Clorox Company, Oakland, Calif.

[21] Appl. No.: 542,240

[22] Filed: Jun. 22, 1990

[51] Int. Cl.[5] ..... C11D 1/30; C11D 3/10; C11D 3/22; C11D 7/12

[52] U.S. Cl. ..... 252/549; 252/94; 252/156; 252/546; 252/554; 252/558; 252/174.14; 252/174.17; 252/174.21; 252/174.24; 252/174.25; 252/180; 252/181; 252/DIG. 11

[58] Field of Search ..... 252/549, 550, 180, 558, 252/554, 156, 174.14, 174.17, 181, DIG. 11

[56] References Cited

U.S. PATENT DOCUMENTS

| | | | |
|---|---|---|---|
| 2,826,552 | 3/1958 | Bonewitz et al. | 252/180 |
| 3,254,034 | 5/1966 | Dwyer et al. | 252/430 |
| 3,766,077 | 10/1973 | Hwa et al. . | |
| 3,985,728 | 10/1976 | Lin | 536/120 |
| 4,088.640 | 5/1978 | Detroit | 260/124 R |
| 4,874,537 | 10/1989 | Peterson et al. | 252/99 |

FOREIGN PATENT DOCUMENTS 1485606 9/1977 United Kingdom .

*Primary Examiner*—Paul Lieberman
*Assistant Examiner*—Erin M. Higgins
*Attorney, Agent, or Firm*—Harry A. Pacini

[57] ABSTRACT

Cleaning composition and method comprising in a first embodiment an alkali metal carbonate builder and a fabric encrustation prevention system comprising a substoichiometric level of lignosulfonic acid or its salts and esters which acts to inhibit and prevent the deposition of insoluble precipitates containing water hardness ions on fabrics; in a second embodiment the cleaning composition includes a detersive surfactant for laundry applications; in either embodiment the following adjuncts may be included: co-builders, alkali metal silicates, bleaching species, enzymes, fragrances, dyes, brighteners and others.

20 Claims, No Drawings

COMPOSITION AND METHOD FOR FABRIC ENCRUSTATION PREVENTION COMPRISING A LIGNIN DERIVATIVE

This invention relates to compositions and methods for preventing fabric encrustation by decreasing or suppressing the formation of encrustation residue when using detergent applications and formulations during fabric washing operations with "hard water." In particular, this invention relates to the use of lignosulfonates to prevent growth or deposition of insoluble compounds on fabric surfaces during washing operations. The invention is primarily concerned with inhibition and prevention of the formation and deposition of insoluble compounds on fabric.

The growth of insoluble compounds on fabric surface (fabric encrustation) from repeated washing with non-phosphate detergents in "hard water" is a negative effect in which the appearance and feel of the fabric are affected. The fabric acquires a rough feel and colored garments have a faded appearance.

The insoluble compounds primarily are calcium and magnesium carbonate precipitates caused when hard water containing calcium and magnesium ions react with builders, such as sodium carbonate, typically used in non-phosphate detergents. Therefore, the prevention of encrustation or the deposition of insoluble compounds formed during the washing process with "hard water" is strongly desired. Phosphonates and polyacrylates have been shown to be effective in detergent applications for the prevention of encrustation. Phosphonates can function as crystal growth inhibitors which prevents the growth of insoluble calcium and magnesium compounds at substoichiometric concentrations. Polyacrylates can function as sequestering and dispersing agents, as well as crystal growth inhibitors Some drawbacks associated with phosphonates and polyacrylates are that phosphonates can contribute to euthrophication and polyacrylates have limited biodegradability.

Heavy-duty laundry detergents typically contain two major ingredients, surfactant and builder, and a number of other ingredients essential to an acceptable product. Although of lesser importance to detergency, these additional ingredients impart certain desirable functions to the total formulated detergent. These miscellaneous ingredients include anti-corrosion agents, bleaches, enzymes, anti-soil redeposition agents, fluorescent whitening agents, perfume and the like. The two major components most essential to detergency are surfactant and builder.

The surfactant provides detersive action to the detergent. This is based on their fundamental characteristic to absorb or concentrate at the soil/fiber/water interfaces. The detergent builder functions primarily to prevent divalent calcium and magnesium water-hardness causing ions from interfering with the surfactant action. The builder also may provide alkalinity thus improve fatty acid saponification and buffering capacity, prevent flocculation, maintain ionic strength, extract metals from soils and remove alkaline-earth metal ions from the washing solutions. Phosphates are extremely effective builders; however, they are in disfavor due to their eutrophication effect on lakes and streams. Many states in the United States have enacted legislation limiting phosphate content. Such legislation to reduce phosphate content has led to a variety of non-phosphate builders, either proposed and/or employed. Examples include silicates, zeolites, carbonates and polycarboxylates, citrates, EDTA and sodium nitrilotriacetate (NTA). Such alternatives are themselves subject to various limitations. Silicates are not preferred because they are not entirely water-soluble and they can therefore deposit onto fabrics, and also can form precipitates with the hardness ions. Zeolites are generally effective co-builders, but not as the sole builder. Polycarboxylate builders are costly.

High levels of alkali-metal carbonates have been found to be an effective non-phosphate builder, particularly in applications where a high pH is required, e.g., for oily soil removal. A drawback associated with such high carbonate levels is that calcium and magnesium ions present in the washing water readily form precipitates with the carbonates, and such precipitates deposit and/or form on the fabrics. These precipitates leave the fabrics with a rough feel and faded appearance. Various approaches have been employed in the art to combat the formation of calcium or magnesium precipitates, including the addition of seed crystals, crystal growth inhibitors and non-precipitating sequestrants. Non-precipitating sequestering and complexing agents tend to be expensive due to the stoichiometric levels needed, adding significantly to the overall formula cost. Generally recognized crystal growth inhibitors for combating encrustation are polyacrylic acids and phosphonates. Polyacrylic acids, also referred to as polymers, may pose ecological problems of their own due to their non-biodegradability. Phosphonates can contribute to euthrofication since they contain phosphorus.

DISCUSSION OF PRIOR ART

U.S. Pat. No. 3,766,077 relates to mixtures of lignosulfonic acid or water-soluble lignosulfonates and water-soluble organic polymers or polymer salts which were found to greatly inhibit the formation of calcium and magnesium containing scale from aqueous solutions on heat exchanger surfaces.

British Pat. 1,485,606, relates to methods of preventing encrustation, drying patches and films during the final rinsing operation on glass, lacquered or metal surfaces during final rinsing operations with hard water.

The present application relates to the method for using lignosulfonate compounds as effective fabric encrustation preventatives in detergent applications and formulations. The prior art relates only to the use of lignosulfonates to inhibit scale formation or dry patches and films in rinsing operations. Clearly, the addition of lignosulfonates into sodium carbonate built detergent compositions in order to decrease and/or suppress the formation of encrustation residue on fabrics from hard water minerals is not contemplated by the prior art.

It is therefore an object of the present invention to provide a cleaning composition which does not utilize phosphate builders.

It is another object of the present invention to provide a high carbonate cleaning composition which results in reduced levels of calcium and magnesium salt deposition on fabrics.

It is another object of the present invention to provide a biodegradable compound which prevents carbonate salt precipitation and/or controls encrustation on fabrics.

It is another object of the present invention to provide a cleaning composition which provides good cleaning performance on stains and soils.

It is another object of the present invention to provide a cleaning composition and method for the reduction of fabric encrustation which does not contribute to euthrophication and is biodegradable.

It is yet another object of the present invention to provide a cleaning composition and method for the reduction of fabric encrustation when using high carbonate, or non-phosphate detergent formulations.

SUMMARY OF THE INVENTION

It has now been found that by using the compositions and method in accordance with the present invention, fabric encrustation can be reduced or eliminated when using high carbonate, non-phosphate detergents with water containing calcium and/or magnesium ions. The compositions and method are characterized by utilizing certain lignosulfonates to prevent growth or deposition of insoluble compounds on fabric surfaces during washing operations with the fabric. More preferably, this invention relates to the use of certain lignosulfonates, or salts thereof, as additives in detergent compositions and methods utilizing said compositions in washing procedures.

More particularly, this invention relates to the use of detergent compositions which contain lignosulfonates with monovalent cations in a concentration from about 1 to about 20 percent by weight, preferably from about 2 to about 12 percent by weight. Further, preferred lignosulfonates and salts thereof will be more fully described hereinafter.

Alkali metal carbonate

The alkali metal carbonate is the primary builder and may be the only builder material of the composition of the present invention. As used herein, the primary builder is defined as that builder which, in total amount, has the higher capacity for hardness ions (e.g., calcium (+2) and magnesium (+2)). The term "co-builder" will refer to any remaining builder which has the lesser capacity for such ions. Alkali metal carbonates, sesquicarbonates and bicarbonates are suitable primary builders; however, the preferred builders are sodium and/or potassium carbonates. A building effective amount of carbonate is present in the compositions herein, which is defined as that amount of alkali metal carbonates, as the primary builder, which would precipitate in the presence of hardness ions, in solution, during a wash period at 50° C. and 250 ppm hardness. Such precipitation is determined by an increase in solution turbidity as indicated by an abrupt change in the turpidity of the solution. Generally, in terms of weight percent, and assuming 68 liters of wash water and about 100 g of composition, at least about 30 percent, preferably 40 percent, most preferably 50 percent carbonate is employed. As used herein, unless otherwise stated, all percentages are weight percentages of actives of the total composition. Higher levels of carbonate will function, however, at levels greater than about 80 percent there is insufficient room for the other ingredients which contribute to the overall effectiveness of the composition. The carbonate acts as the builder to remove divalent metal ions such as calcium, and additionally provides alkalinity and aids in soil removal. At the high levels disclosed herein, the alkali metal carbonate provides good cleaning performance and in situations requiring a high pH, such as oily soils, the carbonate builder may be superior to other builders.

Lignosulfonate Encrustation Preventative System

The preventative system comprises substoichiometric levels of a lignosulfonic acid or its salts (hereinafter referred to as "lignosulfonates"), which act to inhibit and prevent significant precipitates containing water hardness ions. For purposes herein, substoichiometric levels of the lignosulfonate are defined to mean levels which are insufficient to prevent the precipitation of calcium and magnesium carbonate by sequestering water hardness ions. For example, such levels generally comprise less than about 30 percent, more preferably less than about 20 percent, of the total building capacity.

Lignin is a natural occurring component of wood. The major derivative of lignin is lignosulfonate and this form of lignin is commercially and readily available. The lignin molecule is complex and can enter into many types of chemical reactions. This versatility allows it to be modified into various chemicals whose properties are varied. One of the main sources of lignin is from spent pulping liquors, known as "black liquor," where lignocellulosic materials such as wood, straw, corn stalks, and the like are processed to separate the cellulose fibers or pulp from the lignin. The lignins employed to make the adducts and derivatives useful in the present invention include both alkali lignins from the sulfonate pulping process and lignins derived from other alkaline processes such as the soda or modified soda processes and sulfonated lignins, such as sulfite lignins from acid and neutral processes or sulfonated alkali lignins. The amount of such lignin derivatives is about 1 to 20% by weight of the composition.

Alkali lignins are usually recovered from black liquor as water-insoluble products by acidification and precipitation procedures. Lignin obtained from the Kraft, soda or other alkaline processes is not recovered as a sulfonated product, but may easily be sulfonated, if desired, by reacting the product with a bisulfite or sulfite.

By the term "sulfonated lignin" it is meant any lignin containing at least a solubilizing effective amount of sulfonate groups to solubilize the lignin in water. This includes lignins from the sulfite process and sulfonate alkali lignins. Any of the sulfonated lignins may contain up to 50% of the other materials such as carbohydrates, phenols, and other organic or inorganic compounds. The presence of these materials results in large consumption of the reactants used to form the adducts; therefore, some purification of the lignin starting material is often desirable. The lignosulfonate molecule is particularly complex even in its unmodified form. While its exact nature is unknown, research has revealed that the molecule's basic building unit is a phenylpropane derivative. The macromolecule is thought to be made up of these units arranged in branched, polyaromatic chains. The term "lignin" refers to a mixture of substances having similar chemical compositions but structural differences. Therefore, lignosulfonate molecules, like many other polymers or macromolecules, contain a wide range of different molecular weights. Negatively charged sulfonate groups near the surface of the molecule maintain its solubility in water, while carboxylic and phenolic groups are also involved.

Preferred lignosulfonates are described as high molecular weight, water-soluble, anionic, surface-active derivatives of lignins, such as sulfonated lignin carboxylate. Lignosulfonates are available from Westvaco, Charleston Heights, S.C.; Reed Lignin, Houston, Tex.; and Georgia Pacific, Ballingham, Wash.

In a second embodiment, the cleaning composition comprises a detergent composition including:

(a) an alkali-metal carbonate builder;

(b) an encrustation prevention system comprising substoichiometric levels of lignosulfonic acid or its salts; and (c) a surfactant.

Components (a) and (b) are as described previously with respect to the first embodiment. Component (c) is further described below.

Surfactant

A myriad of surfactants are known to be suitable for laundry applications, including anionic, cationic, nonionic and amphoteric surfactants. Preferred surfactants are anionic, nonionic and mixtures thereof, and if added are present in a cleaning-effective amount. Preferred anionics are selected from surfactants such as alkali metal alkyl sulfates, primary and secondary alkane sulfonates, linear alkyl benzene sulfonates, alkyl ether sulfates, and mixtures thereof. These anionic surfactants will preferably have alkyl chain groups averaging about 8 to 18 carbon atoms. The preferred anionic surfactant is a LAS having an alkyl group averaging 8 to 18 carbons. Commercial sources of such surfactants are the Stephan Chemical Company (Northfield, Ill.) and the Vista Chemical Company (Houston, Tex.). An additionally preferred anionic surfactant, principally for its cleaning effectiveness, is a secondary alkane sulfonate. An example of a particularly preferred secondary alkane sulfonate is HOSTAPUR SAS, a trademarked product manufactured by Farbwerke Hoechst A.G. (Frankfurt, West Germany).

It is most preferred to include with the anionic surfactant at least one nonionic, especially $C_{1-4}$ alkoxylated aliphatic alcohols and $C_{1-4}$ alkoxylated alkyl phenols. Particularly preferred are ethoxylated/propoxylated $C_{8-14}$ alcohols. There should be at least about three alkoxy groups per alcohol, preferably at least about nine. Examples of preferred ethoxylated/propoxylated aliphatic alcohols are BASF Corporation's (Parsippany, N.J.) trademarked INDUSTROL, and PLURAFAC. Certain $C_{1-4}$ alkylene oxide copolymers such as ethylene oxide/propylene oxide copolymers are also preferred as surfactants. These are exemplified by BASF's trademarked PLURONIC series. Other suitable nonionic surfactants are polyethoxylated alcohols manufactured and marketed by the Shell Chemical Company (Houston, Tex.) under the trademark NEODOL. Examples of preferred NEODOLS are NEODOL 25-7 which is a mixture of 12 to 15 carbon chain length alcohols with about 7 ethylene oxide groups per molecule, NEODOL 23-65, a $C_{12-13}$ mixture with about 6.5 moles of ethylene oxide, and NEODOL 25-9, a $C_{12-15}$ mixture with about 9 moles of ethylene oxide. Also useful are a trimethyl nonyl polyethylene glycol ether, manufactured and marketed by Union Carbide Corporation under the trademark TERGITOL TMN-6, and an octyl phenoxy polyethoxy ethanol sold by Rohm and Haas (Philadelphia, Pa.) under the trademark TRITON X-114. Total surfactant content is preferably from 1% to about 20%, more preferably from about 2% to 15%.

In a third embodiment, the present invention comprises a dry, granular laundry detergent composition comprising:

(a) an alkali-metal carbonate builder;

(b) a lignosulfonate encrustation inhibitor system;

(c) a surfactant;

(d) a bleach;

(e) an alkali-metal silicate;

(f) a filler; and (g) laundry adjuncts.

Elements (a), (b) and (c) are as described in the first and second embodiments. Elements (d) through (g) are further described hereinbelow.

Bleach

Preferred peroxygen bleaches are available in solid form and include sodium percarbonate, sodium perborate, sodium phosphate peroxyhydrate, potassium permonosulfates and metal peroxides. Bleach activators, also known as peracid precursors, can be included with the peroxygen compounds. Examples of activators include tetraacetyl ethylenediamine (TAED), nonanoyloxy benzene-sulfonate (NOBS), and nonanoylglycolate phenol sulfonate (NOGPS). NOBS and TAED are disclosed, for example, in U.S. Pat. No. 4,417,934, Chung et al., and NOGPS is disclosed, for example, in U.S. Pat. No. 4,778,618, Fong et al., the disclosures of which are incorporated herein by reference. Peracid bleaches (including monoperacids and diperacids) may be advantageous in terms of bleaching performance. Suitable peracid bleaching species include $C_{8-12}$ alkyl peracids, especially perazelaic and diperazelaic acids, diperoxydoiecanedioic acid (DPDDA), and alkyl monoperoxysuccinic acid. Peracid bleaching species, and a method for their production, are described in U.S. Pat. No. 4,337,213 to Marynowski et al., the disclosure of which is incorporated herein by reference. The bleach is present in an amount sufficient to provide effective bleaching, e.g., from about 0% to 0% by weight active, more preferably from about 0.05% to 5% by weight active depending on the bleaching species chosen.

Also suitable are chlorine bleaches which could be incorporated preformed suspended on a substrate, mitigated or formed in situ.

Alkali-metal Silicate

An alkali-metal silicate can be included to provide alkalinity and corrosion resistance. Preferred is one having the formula:

$$M_2O(SiO_2)_n$$

where M represents an alkali-metal and n is between about 1 and 4. Preferred alkali-metal silicates are sodium, potassium and lithium silicates, with sodium silicate being the most preferred, and with a preferred n value of 2.0–2.4. A most preferred maximum value for n is about 3.2 in order to minimize insoluble silicates during storage. It is further preferred that at least about 10% of the total silicates have an n value of greater than about 1.6 to impart suitable anti-corrosive properties. Examples of other suitable silicates include sodium or potassium orthosilicates and metasilicates. As used hereinafter, the term "silicate" will be taken to mean any of these alkali-metal silicates, individually or combined.

Mixtures of any of the foregoing alkali-metal silicates are also suitable. The alkali-metal silicate is present in an amount of from about 0% to 10%, preferably about 2% to 5%. A minimum of about 1% silicate is preferred to provide adequate corrosion resistance. A commercially available sodium silicates is sold by the Philadelphia Quartz Corporation (Valley Forge, Pa.) under the trademarks RU (as a 47% solution) and D (as a 44.1% solution). In addition to their anti-corrosive effects, the silicates provide alkalinity and serve as processing aids to increase particle size of the agglomerates. Sodium silicates also aid in cleaning, especially on oil and grease stains.

Filler

The filler is preferably a salt such as sodium chloride, nitrate or sulfate, and is used to adjust the composition density to achieve desired physical characteristics, e.g., grain size and flowability. Depending on the filler and the process used, the filler can also provide surface area for loading of actives. The filler material additionally assists in solubility under cold water washing conditions. Sodium chloride is preferred due to its low cost and availability. However, other materials, such as puffed borax, bentonite clays and inorganic salts such as sodium or potassium sulfate, chloride, bromide, nitrate, and borate, and organic materials like sugars may also be suitable. Some water may be deliberately added as a filler. Generally, about 0–30% filler will be present, preferably about 5–25%.

Co-Builder

Optionally, any non-phosphate builder material known in the art to be compatible with the high carbonate formulation herein may be included as a co-builder selected from the group consisting of silicates, citrates, alkali metal carbonates, polymeric polycarboxylic acids such as polyacrylates and maleic anhydride based copolymers, zeolites, salts of ethylene diamine, tetraacetic acid and sodium nitrilotriacetate. Silicates at levels above about 10%, and citrates may be added as co-builders. If added, the co-builder should comprise no more than about 30% of the total weight of the composition, and preferably no more than about 20%. Zeolites are preferred as optional co-builders since they perform well when used in a non-encrustation promoting amount. A non-encrustation promoting amount is that amount which will not contribute to or encourage the encrustation formation when present in a detergent formulation and in the presence of water hardness ions.

Zeolite A is available, for example, from the PQ Corp., Valley Forge, Pa., under the trademark VALFOR 100. Zeolite A typically includes about 21% moisture.

Adjuncts

While the alkali-metal carbonate is generally sufficient to keep the wash pH range within the desired limits, it may be desirable to adjust the pH of the wash water by including an electrolyte/buffer. Generally, these are alkali-metal inorganic acid salts, hydroxides or oxides. It may also be suitable to use such materials as aluminates and organic materials, such as gluconates, citrates, succinates, maleates, and their alkali metal salts. The wash pH range should be maintained between about 8.0 to 13.0, more preferably about 9.0 to 12.0. If an electrolyte/buffer is needed, sodium hydroxide is preferred, as it does not interact adversely with any other ingredients and is very cost effective. The amount of electrolyte/buffer added solely for purposes of buffering can vary from about 0% to 10%.

In the standard composition, minor additions can be included in the present invention. These include dyes, such as Monastral blue and anthraquinone dyes (such as those described in Zielske, U.S. Pat. No. 4,661,293 and U.S. Pat. No. 4,746,461). Pigments, which are also suitable colorants, can be selected, without limitation, from titanium dioxide and ultramarine blue (see also, Chang et al., U.S. Pat. No. 4,708,816). Fluorescent whitening agents are other desirable adjuncts. These include the stilbene, styrene, and naphthalene derivatives, which upon being impinged by ultraviolet light, emit or fluorescent light in a visible wavelength. These fluorescent whitener agents or brighteners are useful for improving the appearance of fabrics which have become dingy through repeated soilings and washings. Preferred fluorescent whitener agents are TINOPAL 5BM-GX and TINOPAL AMS, both from Ciba Geigy A. G., (Tom River, N.J.) and PHORWITE RKH, from Mobay Chemicals (Union, N.J.). Enzymes particularly hydrolases such as lipases, proteases and amylases, are useful in the compositions herein. Suitable commercial sources include ESPERASE and SAVINASE, both trademarked products of Novo Industries (Danbury Conn.). Generally, very low level of enzymes are needed, i.e. from about 0.1% to 1.0% by weight. Fragrances are also desirable adjuncts in these compositions. The total composition minors will range from 0% to about 5%. Anti-redeposition agents, such as carboxymethyl-cellulose, are potentially desirable. Foam boosters, such as appropriate anionic surfactants, may be appropriate for inclusion herein. Also, in the case of excess foaming resulting from the use of certain surfactants, anit-foaming agents, such as alkylated polysiloxanes, e.g., dimethylpolysiloxane, would be desirable. Water may be present as free water or as water of hydration of the inorganic salts such as sodium carbonate. The detergent composition is prepared by a process which yields a dry, free-flowing granular mixture, for example agglomeration or spray drying. However, the compositions herein are not limited to such forms, and may also be formulated in other dry forms, such as tablets or beads, or may be formulated as pastes, gels or liquids. An example formulation is shown below as Example A.

EXAMPLE A

| Ingredient | Wt. % Active |
|---|---|
| Alkali metal carbonate | 30–80 |
| Surfactant | 1–20 |
| Bleaching agent | 0–10 |
| Alkali metal silicate ($SiO_2/M_2O$) | 0–10 |
| Filler | 0–30 |
| Lignosulfonate | 0.1–15 |
| Composition Minors (enzymes, FWA's, fragrances, etc.) | 0–5 |
| Co-builder | 0–30 |
| Water | 0–15 |

EXPERIMENTAL

To assess effectiveness of the compositions herein in reducing encrustation deposition, 100% terry cloth washcloths were washed for multiple cycles, under the given wash conditions. A base detergent composition consisting of 54% $Na_2CO_3$, 13.3% surfactant, 5.0% sodium silicate and 4% sodium perborate. The lignosulfonate compound was added to the base composition in the amounts indicated in each case as exemplified in Table II. About ¾ cup (125 gm/use) of detergent and about 68L of wash water was used for each washload.

Results after washing the fabric are shown in Table II as percent residue remaining after heating to 950° C. in oxygen.

TABLE I

| Composition of the Detergent Base | |
|---|---|
| Component | gm/use |
| Sodium carbonate | 61.0 |
| Sodium perborate | 5.0 |
| Sodium chloride | 22.0 |
| Silicate (2.4 ratio) | 5.0 |
| NEODOL 25-9 (alcohol ethoxylate) | 11.0 |
| LAS (linear alkyl benzene sulfonate ($C_{13}$) anionic surfactant | 2.5 |
| Diethanol cocamide (nonionic surfactant) | 1.5 |
| Moisture | 5.2 |
| | 113.2 gm/use |

TABLE II

| Multicycle Wash Testing of Lignosulfonate | |
|---|---|
| Treatment[a] | Wt. % Ash on Cotton[b] Washclothes After 5 Cycles 35° C./200 ppm |
| Base only | 1.9 |
| Base + 7.5 gm lignosulfonate | 0.4 |
| Base + 15 gm lignosulfonate | 0.1 |
| Base + 7.5 gm Acrysol LMW45N (4500 MW polyacrylate) | 0.4 |

[a]Lignosulfonate (Kelig 3000D, available from Reed Lignin, Houston, TX) was added to the processed detergent base. The detergent composition is given above.
[b]Ash is defined as the residue remaining after pyrolysis at 950° C. in oxygen. Expressed as weight percent.

Table II shows that substoichiometric levels of the instant encrustation preventative system (lignosulfonate) yielded less calcium residue (as ash) than the base deterent composition at two different treatment levels. Further, the residue reduction compared to a prototype non-phosphate detergent base with a polyacrylate was equal or greater in the instant case. Lignosulfonate could be a direct replacement for polyacrylate which is known for its anti-precipitatant nature. Furthermore lignosulfonate, unlike polyacrylates, are highly biodegradeable.

While this invention has been described and illustrated with specific examples and descriptions, it is understood that the invention is not to be limited to the exact details of operation or exact components shown and described herein, as obvious modifications and equivalents will be apparent to those skilled in the art to which this invention pertains. Therefore, the invention is to be limited only by the scope within the claims appended hereto.

What is claimed is:

1. A non-phosphate fabric cleaning composition comprising:

(a) a building effective amount of an alkali metal carbonate detergent builder; and (b) a fabric encrustation preventing amount of an encrustation preventing system, including a substoichiometric amount of a lignin derivative selected from the group consisting of lignin sulfonic acid, salts or esters of lignin sulfonic acid and mixtures thereof, said amount being from about 1 to about 20% by weight.

2. The composition of claim 1 wherein the alkali metal carbonate is from about 20 to about 80 weight percent.

3. The composition of claim 1 wherein the alkali metal carbonate is from about 30 to about 70 weight percent.

4. The composition of claim 1 wherein the said composition includes a detersive cleaning-effective amount of a surfactant, selected from the group consisting of anionic, nonionic, cationic, amphoteric surfactants and mixtures thereof.

5. The composition of claim 4 wherein said surfactant is selected from the group consisting of alkyl sulfates, primary and secondary alkyl sulfonates, linear alkyl aryl sulfonates, alkyl ether sulfates, alkoxylated aliphatic alcohols, alkoxylated alkyl phenols, copolymers of $C_{1-4}$ alkylene oxides, and mixtures thereof.

6. The composition of claim 1 and further including a bleaching effective amount of a bleaching species.

7. The composition of claim 1 and further including a non-encrustation promoting amount of a co-builder selected from the group consisting of silicates, citrates, alkali metal carbonates, polymeric polycarboxylic acids, zeolites, salts of ethylene diamine tetraacetic acid and sodium nitrilotriacetate.

8. The composition of claim 7 wherein the co-builder is a non-encrustation promoting amount of zeolite.

9. The composition of claim 1 and further including about 1-10% of an alkali metal silicate.

10. The composition of claim 1 wherein said alkali metal carbonate is sodium carbonate; and said lignin derivative is a high molecular weight anionic sulfonated lignin carboxylate.

11. A non-phosphate fabric cleaning composition consisting essentially of (a) a building effective amount of an alkali metal carbonate from about 20 to about 80 weight percent;

(b) from about 1 to about 10 percent of a sodium silicate having a ratio of $SiO_2/M_2O$ of about 1 to about 4, wherein M is an alkali metal;

(c) a substoichiometric amount of a lignin derivative selected from the group consisting of lignin sulfonic acid and mixtures thereof, said amount being from about 1 to about 20% by weight;

(d) a detersive cleaning-effective amount of a surfactant, selected from the group consisting of anionic, nonionic, cationic, amphoteric surfactants and mixtures thereof; and (e) a bleach effective amount of a bleaching species.

12. The composition of claim 11 wherein said alkali metal carbonate amounts to from about 30 to about 70 weight percent.

13. The composition of claim 11 wherein said alkali metal carbonate is the primary builder and a co-builder selected from the group consisting of silicates, citrates, alkali metal carbonates, polymeric polycarboxylic acids, zeolites, salts of ethylene diamine tetraacetic acid and sodium nitrilotriacetate.

14. The composition of claim 11 wherein said co-builder is a non-encrustation promoting amount of zeolite.

15. The composition of claim 11 wherein said surfactant is selected from the group consisting of alkyl sulfates, primary and secondary alkyl sulfonates, linear alkyl aryl sulfonates, alkyl ether sulfates, alkoxylated aliphatic alcohols, alkoxylated alkyl phenols, copolymers of $C_{1-4}$ alkylene oxides and mixtures thereof.

16. A method for reducing water causing hardness ion precipitation and deposition on fabric comprising contacting the fabric with a cleaning effective amount of an aqueous solution of a detergent composition comprising (a) a building effective amount of an alkali metal carbonate builder from about 20 to about 80 weight percent;

(b) from about 1 to about 10 percent of a sodium silicate having a ratio of $SiO_2/M_2O$ of about 1 to about 4, wherein M represents an alkali metal;

(c) a substoichiometric amount of a lignin derivative selected from the group consisting of lignin sulfonic acid, salts or esters of lignin sulfonic acid and mixtures thereof, said amount being from about 1 to about 20% by weight;

(d) a detersive cleaning effective amount of a surfactant, selected from the group consisting of anionic, nonionic, cationic, amphoteric surfactants and mixtures thereof; and (e) a bleach effective amount of a bleaching species.

17. The method of claim 16 wherein said amount of alkali metal carbonate is from about 30 to about 70 weight percent.

18. The method of claim 13 wherein the alkali metal carbonate is the primary builder and a co-builder selected from the group consisting of silicates, citrates, alkali metal carbonates, polymeric polycarboxylic acids, zeolites, salts of ethylene diamine tetraacetic acid and sodium nitrilotriacetate.

19. The method of claim 18 wherein the co-builder is a non-encrustation prompting amount of zeolite.

20. The method of claim 17 wherein said surfactant is selected from the group consisting of alkyl sulfates, primary and secondary alkyl sulfonates, linear alkyl aryl sulfonates, alkyl ether sulfates, alkoxylated aliphatic alcohols, alkoxylated alkyl phenols, copolymers of $C_{1-4}$ alkylene oxides and mixtures thereof.

* * * * *